US006336510B1

(12) United States Patent
Gadini

(10) Patent No.: US 6,336,510 B1
(45) Date of Patent: Jan. 8, 2002

(54) SPRINKLER DEVICE FOR FIRE EXTINGUISHING SYSTEMS

(75) Inventor: Costanzo Gadini, Casale Monferrato (IT)

(73) Assignee: Eltek S.p.A., Casale Monferrato (IT)

( * ) Notice: Subject to any disclaimer, the term of this patent is extended or adjusted under 35 U.S.C. 154(b) by 0 days.

(21) Appl. No.: 09/554,823

(22) PCT Filed: Sep. 21, 1999

(86) PCT No.: PCT/IB99/01563

§ 371 Date: Jul. 17, 2000

§ 102(e) Date: Jul. 17, 2000

(87) PCT Pub. No.: WO00/16855

PCT Pub. Date: Mar. 30, 2000

(30) Foreign Application Priority Data

Sep. 22, 1998 (IT) ..... T098A0802

(51) Int. Cl.[7] ..... A62C 37/08

(52) U.S. Cl. ..... 169/37; 169/19; 169/56; 169/90; 137/79; 236/99 G; 236/99 K

(58) Field of Search ..... 169/19, 37, 42, 169/56, 60, 90, DIG. 3; 137/79; 236/95, 99 K, 99 G, 100

(56) References Cited

U.S. PATENT DOCUMENTS

| | | | | | |
|---|---|---|---|---|---|
| 2,230,179 | A | * | 1/1941 | Cid | 169/37 |
| 3,719,320 | A | * | 3/1973 | Morris et al. | 236/99 G |
| 3,802,510 | A | * | 4/1974 | Johnson | 169/37 X |
| 3,874,455 | A | * | 4/1975 | Klesow | 169/37 C |
| 3,991,829 | A | * | 11/1976 | Johnson | 137/79 C |
| 4,176,786 | A | * | 12/1979 | Braukmann | 236/99 K |

* cited by examiner

*Primary Examiner*—Steven J. Ganey
(74) *Attorney, Agent, or Firm*—Levine & Mandelbaum

(57) ABSTRACT

A sprinkler device for fire extinguishing systems is adapted to be coupled to a fluid supply line and placed in an environment which is to be protected from fire. The device has an actuator sensitive to room temperature which causes motion of a shutter for controlling the flow of the fluid to an outlet when the room temperature exceeds a predetermined threshold. The actuation device has an unbreakable container in which there is stored a material having a volume which is a function of the container's temperature, a shaft movable in response to a change in volume of the material, and a closure and sealing device for the chamber and shaft.

32 Claims, 6 Drawing Sheets

SPRINKLER DEVICE FOR FIRE EXTINGUISHING SYSTEMS

DESCRIPTION

The present invention refers to a sprinkler device for fire extinguishing systems. These sprayer devices, also known with the English term "sprinkler", are usually coupled to a supply line of a pressurized fluid or liquid, typically water, and placed above a predetermined area to be protected against possible damages caused by a fire.

Usually the sprinkler device comprises a body made from metal material having an inlet duct and an outlet duct between which a path is delimited for the liquid; the inlet duct is apt to be coupled with the above fluid supply line, whereas a diffuser means integral with the body of the sprinkler device is usually located below the outlet duct, which is apt to sprinkle the liquid with a rainjet over the area to be protected.

A shutter is arranged upstream or in correspondence with the outlet duct which, under normal conditions (i.e. in the absence of a fire) hinders the fluid outflow from the sprinkler device. Moreover, room temperature sensing means are associated with the body of the sprinkler device, which are usually directly exposed to the area to be protected; when a predetermined temperature threshold (indicative of a fire) is exceeded, such means cause the shutter to move, so as to let the liquid flow through the outlet duct towards the diffuser underneath, which will then sprinkle the area to be protected.

As it can be seen, the above devices are apt to cause the automatic opening of the liquid supply line, in order to obtain the flames extinction, should the room temperature increase to an extent deemed to be excessive; accordingly, it is also clear that the sprinkler devices need to have means for sensing the temperature of the room where they operate, and be able to fastly switch when a predetermined temperature threshold is exceeded.

The room temperature sensing means, which as said are also provided for enabling the fluid outflowing from the sprinkler device, may be of various types.

Usually, such means consist of a tightly sealed container, such as a glass bulb, containing a material which expand as a function of the temperature of same container; in the instance of a fire, the volume increase of the expansible material, due to a temperature increase of the container, will cause the latter to break out.

According to this solution, the container is placed in the sprinkler body to keep a shutter plug in closure of the liquid outlet duct, somewhat like a prop or supporting column; the cracking of the container, caused by the too high room temperature, deprives the plug of its support, which is expelled from the sprinkler body under the pressure of the fluid available in the path, thus releasing the fluid flow.

In other known solutions, instead of a glass bulb, sensing elements are provided, which are made from alloys melting at predefined temperatures; in such instances a mechanical kinematic motion is usually provided, which has two portions in a precarious welded to each with a melting alloy, so as to obtain a stable supporting column for the shutter plug; following the melting of the alloy, due to the room temperature being too high, the kinematic motion is released in the sense that the two portions may get free from each other, thus releasing the shutter plug and opening the liquid outlet duct.

Though the above solutions are accurate and reliable on an average, they have the drawback of using room temperature means of the disposable type, i.e. which become fully unusable after their first operation, with a consequent need of having to provide for their replacement.

Another associated drawback is that the sprinkler devices using the above room temperature sensing means are unable to provide for the automatic resetting of the closed condition of the fluid supply duct, and therefore to stop the fluid supply also when the fire has ceased, with a consequent damages risk due to water flooding.

Other known sprinklers have room temperature sensing means which on the contrary actuate a shutter capable of motion from a closed position to an open position of the liquid path; such sprinklers are actuated for their opening by the room temperature increase and back, for then returning to their initial closed condition, as soon as the reasons for operation have ceased, thus avoiding possible damages from flooding.

However, such known solutions have the drawback of using a bimetal as a sensing and actuator means, which has a weak force (in the order of a few grams) and a restricted stroke (a few tens of millimeter for small bimetals or anyway a few millimeters for large bimetals, i.e. in the order of a few tens of millimeter) and is not apt to actuate the shutter of the sprinkler device directly; in these instances, the sprinkler device has to be equipped with a complex servo-hydraulic circuit for changing the small bimetal motion in an ample movement of the shutter, whose force is capable of winning the fluid pressure.

Other known sprinkler devices provide the use of a motor-driven shutter; in such instances a special electric or electronic control thermostat has to be provided, which is apt to sense room temperature and electrically supply the motor for causing the shutter motion and consequently the opening of the liquid outlet duct, if required.

However, also these solutions have some drawbacks, in particular due to their dimensions, manufacturing difficulties and cost.

The present invention has the aim of solving the above drawbacks and providing a sprinkler device for fire extinguishing systems which has an improved structure with respect to the known state of the art.

Within this frame, an object of the present invention is to provide a sprinkler device having room temperature sensing means, which do not require to be replaced after their first operation, and which are reliable and efficient with time, have restricted dimensions and a low cost.

Another object of the present invention is to provide such a sprinkler device which allows for an automatic resetting of the closed condition of the fluid supply duct, after the fire has ceased.

These and other objects, as better described in the following, are obtained according to the present invention by a sprinkler device for fire extinguishing systems, having the features of the annexed claims, which form an integral part of the present description.

Further aims, features and advantages of the present invention will become apparent from the following detailed description and the annexed drawings, supplied by way of non limiting example, wherein:

FIGS. 1–3 show a first possible embodiment of a sprinkler device for fire extinguishing systems according to the present invention.

Figure 3:
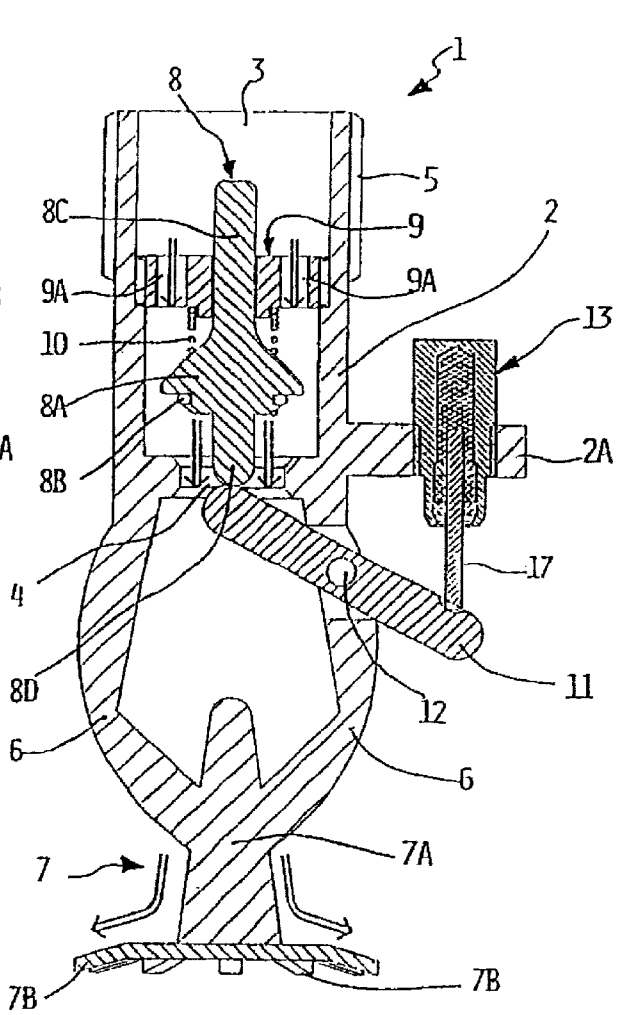
FIGS. 2 and 3 show a section view of the device according to the present invention, along the axis A—A of FIG. 1, in two different working positions.

Such a sprinkler device, being indicated as a whole with 1, comprises a body 2 made from metal material, which is hollow inside to delimit a duct with an inlet 3 and an outlet 4. On its top end, in correspondence with the inlet 3, the body 2 has an attachment or threaded connector 5, for its hydraulic connection to a supply line of a pressurized liquid, such as water, not shown in the figures for simplicity's sake.

Reference 6 indicates one of two supporting rods departing from the body 2 on the sides of the outlet 4, for supporting a distributor 7; such a distributor 7 consists of an element having a substantially tapered shape 7A with its apex directed upwards; segments 7B depart radially from the base of the element 7A, slightly biased downwards and spaced between them. As it can be noticed, the apex of the tapered element 7A is aligned with the outlet 4; thus, the liquid flow eventually coming out of the outlet 4 can freely cover the air gap between the rods 6 and reach the element 7A and segments 7B, which sprinkle the flow with a rain jet.

Reference 8 indicates a shutter inserted in the duct inside the body 2, where it is guided by a support 9 having a substantially disk shape; the support 9 has a central opening for guide a portion of the shutter 8 and peripheral openings 9A, to let the fluid flow through. The shutter 8 is of the axial type, i.e. operating along a direction substantially coinciding or parallel to the axis of the fluid conveying duct.

The shutter 8 has a plug portion 8A provided with proper sealing means 8B, such as an O-ring apt to close up the outlet 4, and a rod portion 8C apt for sliding in the central opening of the support 9. Reference 10 indicates an elastic element, such as a spiral spring, operating between the support 9 and the shutter 8 to maintain, during normal operation, the plug portion 8A of the shutter in closure of the outlet 4. Reference 11 indicates a lever, being pivoted in a point 12 on one of the rods 6.

A first end of the lever 11 is directed towards an extension 8D departing from the lower part of the plug portion BA of the shutter 8; the second end of the lever 1 is pointing towards a thermal-sensitive element, indicated as a whole with 13, which is fixed to a portion 2A of the body 2A provided to that purpose.

The fixing can be advantageously accomplished through a hole with a female thread in the portion 2A, and delimiting a male thread on the external surface of the body of the thermal-sensitive element 13.

Figure 4:
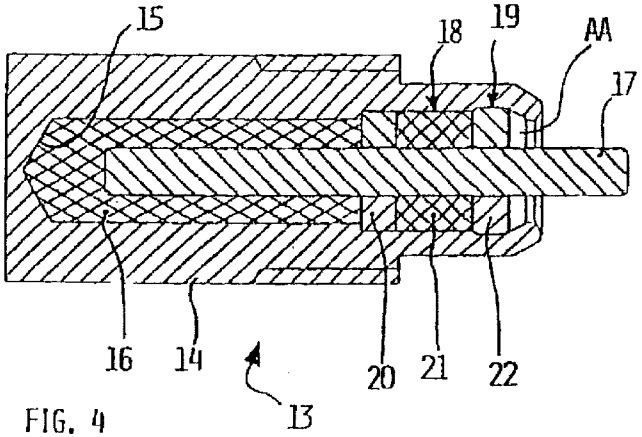
FIG. 4 shows a thermal-sensitive element being part of the sprinkler device according to the present invention.

The thermal-sensitive element 13, as detailed in FIG. 4, comprises a body or housing 14 made from thermal-conductive material; by way of example, the housing 14 can be made from metal and have a quadrangular section (in particular 6×6 mm) or round section (in particular 8 mm diameter); it can therefore be noticed that the housing 14 is unbreakable also upon attaining high temperatures. The housing 14 has an opening AA on one of its lengthwise ends, and a chamber 15 is delimited inside it, which has for instance a cylindrical section; such a chamber 15 contains a material 16, which is expansible in temperature, especially a wax. Reference 17 indicates a shaft or thruster, which may be made for instance from stainless steel, partially inserted in the housing 14 through the cited opening; as it will be appreciated, a portion of the thruster 17 is directly embedded in the material 16, the opposite portion of the shaft exiting the housing 14.

References 18 and 19 indicate two seats, being defined in an area next to the opening of the housing 14 by relevant cylindrical widenings of the chamber 15; as it can be seen, the seat 18 more internal to the housing 14 with respect to the opening, has a greater vertical development compared to the seat 19. In the seat 18 are inserted from the opening AA in the following order: a rigid washer 20 and an elastic gasket or cylindrical bushing 21; the washer 20 is preferably made from metal material, such as brass, whereas the bushing 21 is preferably made from PTFE or Teflon® or similar elastic material.

On the contrary, a washer 22 preferably made from metal, such as brass, is inserted in the seat 19, and having a larger diameter compared to the washer 20; the lower washer 20 is resting on the shoulder delimited between the seat 18 and the chamber 15, whereas the upper washer 22 rests on the shoulder delimited between the seat 18 and the seat 19.

Advantageously, the shoulder delimited between the seat 18 and the seat 19 has a flaring like a funnel, whose function is to ease achievement of the relevant seat 18 for components 20 and 21 during the assembly stage; advantageously, too, the upper washer 22 has a dual flaring, i.e. it is beveled along its circumference on both faces. Such a double flaring of the washer 22 does not only ease its insertion inside the opening, but has also the double function of allowing, on one hand, its exact coupling with the flaring of the shoulder defined between the seat 18 and seat 19 and, on the other hand of guiding the deformation of the end of the housing 14 wherein the cited opening is present to make them match exactly together mechanically during the riveting operation. Such end of the housing 14, is in fact submitted to a riveting operation when manufacturing the element 13. It will also be appreciated that the double flaring of the washer 22 allows its easy assembly in an automated manufacturing process, since no special orientation for it is required.

Therefore, as it can be noticed, the upper washer 22 is housed in a first seat 19 differing from the second seat 18, wherein at least a radial sealing element 21 operates on the thruster 17, and wherein also the washer 20 is inserted, so that the washers 20 and 22 delimits a well defined exact housing area (18, 19) for the sealing element 21; it is obvious that such sealing means 21 could be more than one and manufactured in different shapes and/or materials.

Thus, the above riveting operation of the housing 14 for realizing the closure of the element 13 and then for rusting on the upper washer 22, will not entail any uncontrolled compression risks on the sealing element represented by the element 21; this is just due to the fact Mt the washer 22 and the bushing 21 are housed in two different seats, with the seat of the bushing 18 being more inside the housing 14 and having smaller dimensions compared to the seat 19 of the washer 22; this also avoids the risk that the pressure exerted on the washer during the riveting stage of the body 14 may be too high and cause undesired distortions or tears to the bushing.

It is obvious, on the other hand that, with the use of sufficiently precise machinery, the element 13 could be manufactured without the shoulder being defined between the seat 18 and the seat 19, though warranting the operating features described above.

Important practical effects tom such a manufacture of the thermal-sensitive element 13, for the operation of the bushing 21, are also due to the presence of the lower washer 20. Such a lower washer 20, acting as lower supporting means for the bushing 21, allows an accurate delimitation of the seat wherein the bushing itself should operate, also warranting a large resting surface; finally, the lower washer 20 represents a farther guiding means for the truster 17.

FIG. 4 shows the thermal-sensitive element 13 in its rest position, with the thruster 17 being backward inside the chamber 15.

Following a beat transmission to the housing 14, an expansion of the expansible material 16 takes place, causing a straight displacement of the thruster 17 outwards (up to the position visible in FIG. 3); when heat transmission to the housing 14 decreases or is interrupted, the expansible material 16 shrinks and allow a gradual return of the thruster 17 to its initial rest position, represented in FIG. 3, under the indirect thrust of the spring 10. It will be appreciated, in particular, that the thermal actuator 13 is apt to exert a thrust of a few tens of kilograms, when covering either strokes or displacements of about 10 millimeters.

Figure 2:
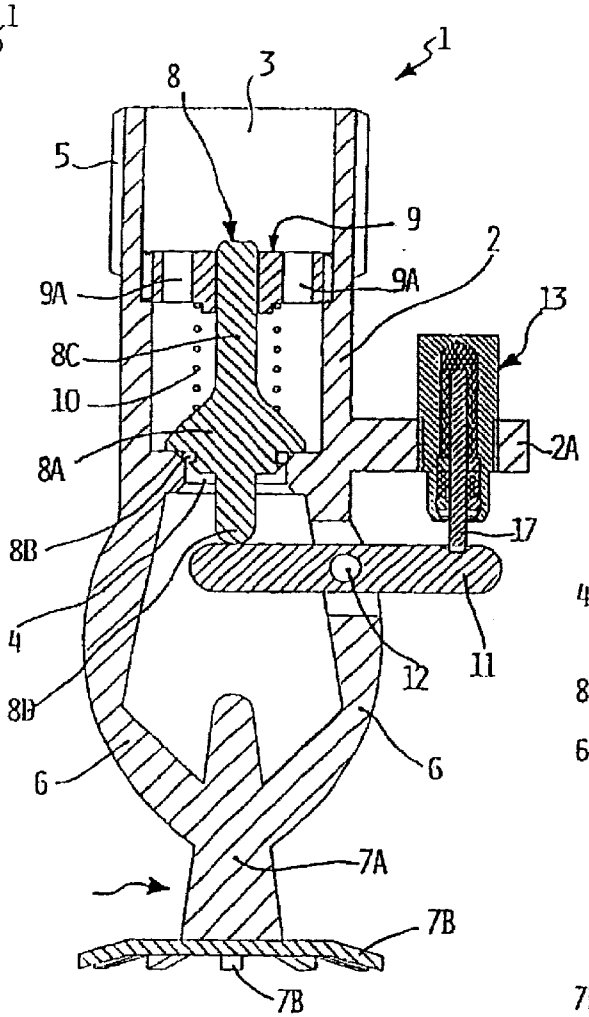

Back to FIGS. 2 and 3, it can be noticed how the second end of the lever 11 is directed towards the thruster 17 of the thermal-sensitive element 13, which operates then in a substantially parallel direction to the axis of the sprier device 1.

In FIG. 2 the sprinkler device 1 according to the present invention is represented in its rest position, i.e. in the absence of fire.

Under such conditions, the sealing means 8B of the shutter 8 operate in closure along the circumference of the outlet 4; in this way, therefore, the outflow of the liquid being present at the inlet of the body 2 is hindered.

It should be noticed that, in general (and independently from the type of embodiment), the sprinkler device according to the present invention is pre-calibrated, i.e. its various components are so assembled to hinder the thermal-sensitive device 13 from operating at a room temperature below a predetermined value, for example 68° C., i.e. maintaining the relevant shutter in closure against a liquid outflow. This means that, during actual use of the device, for instance in a house, the thermal-sensitive device is not apt to cause a fluid outflow unless the room temperature reaches or exceeds a predetermined temperature. It is obvious that various temperature values can be predetermined changing either the type or quantity of expanding material 16, or changing either the position or the working point of the thermal-sensitive element, for instance screwing or unscrewing more its housing in the relevant threaded seat in the body 2.

Figure 1:
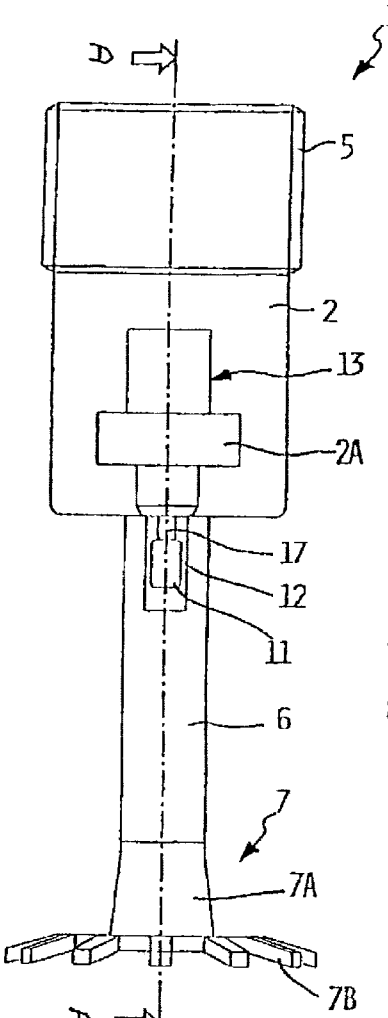
FIG. 1 shows a side view of a first possible embodiment of the sprinkler device according to the present invention.
Figure 14:
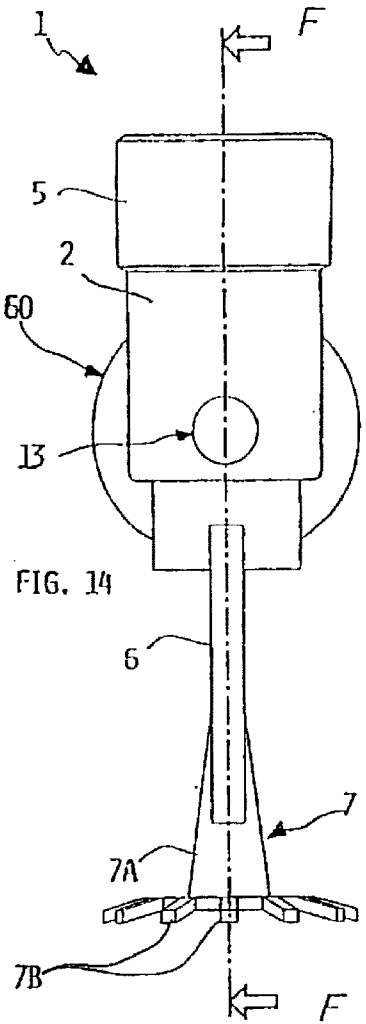
FIGS. 13 and 14 show two orthogonal views of a fourth possible embodiment of the device according to the present invention.
Figure 13:
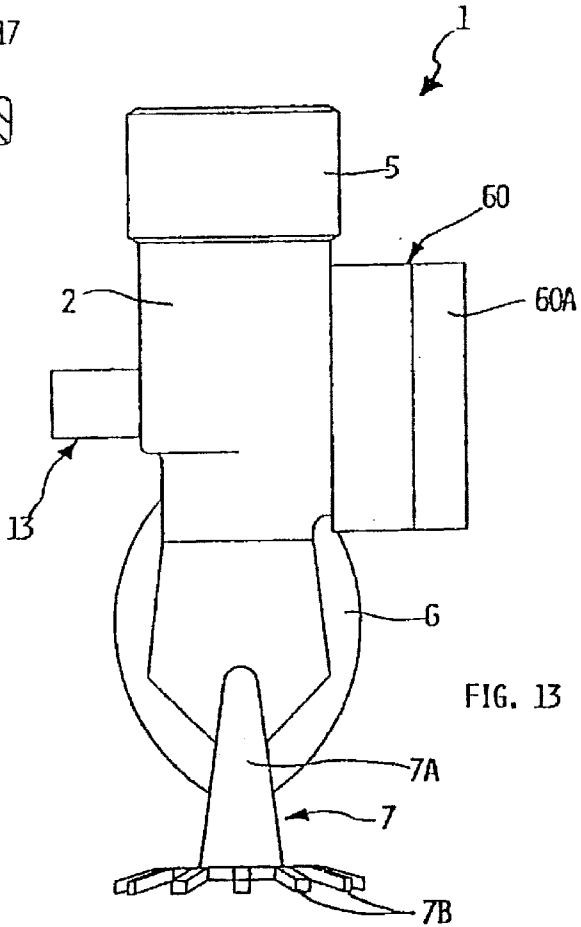

In the example illustrated in FIGS. 1–3, this allows to change the relative position between the thermal-sensitive element 13 and the lever 11, so that a longer or shorter stroke of the thruster 17 is necessary for moving the stopper 8.

Operation of the device shown in FIGS. 1–3 is as follows.

When the temperature in the environment gradually starts to increase, such as due to a fire, a gradual temperature increase of the housing 14 of the thermal-sensitive element 13 will take place; such a temperature increase causes the expansible material 16 contained in the thermal-sensitive device 13 to expand, which in turn causes the motion of the thruster 17 out of the housing 14; as it can be seen in FIG. 3, such a motion of the thruster 17 causes an angular movement of the lever 11, which presses the extension 8D of the shutter 8 and cause the latter to be lifted contrasting the action of the spring 10 and the pressure of the liquid upstream the stopper portion 8A. Thus, the outlet 4 of the device 1 is made to open up, and the flow of the liquid at the inlet of the body 2 is conveyed to the diffuser 7, to be rain sprinkled by it on the area to be protected.

Afterwards, when the room temperature decreases (for example because the fire in the environment where the device 1 is operating is under control), the housing 14 of the thermosetting element 13 cools down and the material 16 contained in it shrinks; thus, the thruster 17 can go backward, towards its original position, also under the thrust of the spring 10 and shutter 8, which is able to occlude the outlet 4 again: in this way the liquid flow exiting the device 1 is stopped, The device 1 is therefore of the self-resettable type; it is in fact clear that, if a new fire breaks out, the device 1 is ready again to operate as previously described.

FIGS. 5–8, where the reference numbers of the previous figures are partially used to indicate technical equivalent elements, represent a second possible embodiment of the sprinkler device according to the present invention.

According to this embodiment, instead of a linear shutter, the sprinkler device 1 has a shutter 30 being spherical and holed, i.e. configured like a pierced ball, which is rotary or angularly movable around an axis being transverse or perpendicular with respect to the axis of the liquid conveying duct in the body 2.

Figure 7:
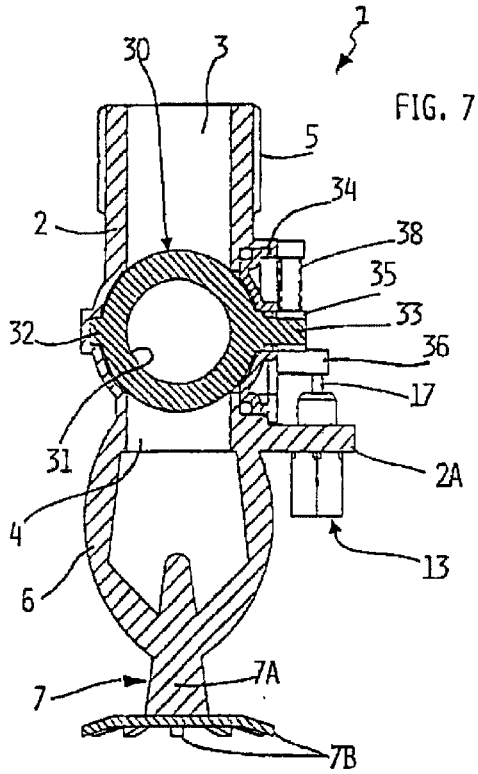
FIGS. 7 and 8 show a section view of the device according to the present invention, along the axis A—A of FIG. 5 and axis C—C of FIG. 6, respectively.
Figure 6:
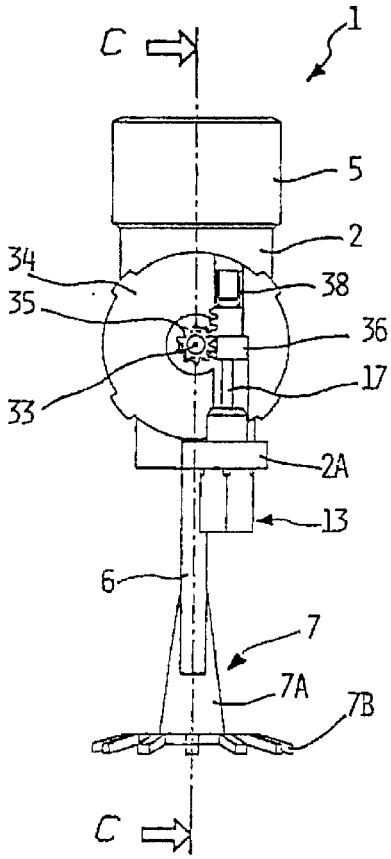
Figure 8:
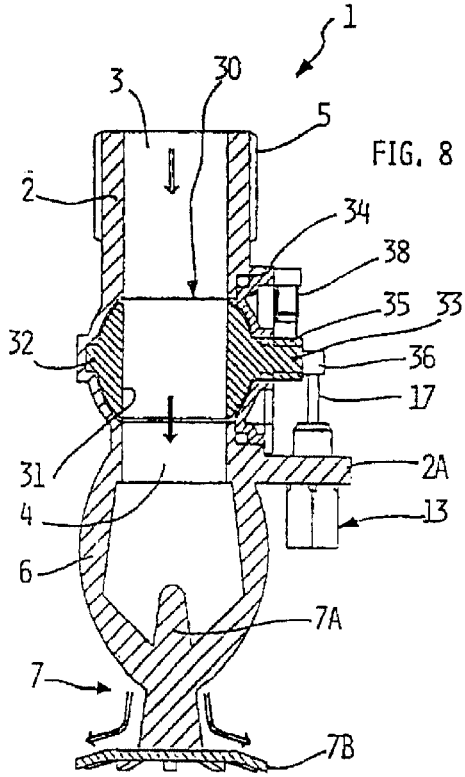

As represented in FIGS. 7 and 8, such a shutter 30 which is housed in the body 2 upstream the outlet 4, has a central hole 31 and two side extensions 32 and 33.

The extension 32 is inserted in a proper seat defined inside the body 2, whereas a part of the extension 33 protrudes outside the body 2, through a central hole of a cover 34; such a cover 34 is provided for occluding an opening delimited in the body 2, for the insertion of the shutter 30 inside the body 2.

On the end of the extension 33 which comes out of the lid 34, a gear 35 is mounted integral, for engaging a rack kinematics 36, substantially L-shaped, which is apt to slide on suitable guide means provided on the external surface of the body 2; reference 38 indicates an elastic element, such as a spiral spring, for contrasting the motion of the kinematics 36 in one direction (i.e, upwards) and favor it in the other direction (i.e, downwards).

The rack kinematics 36 can be linearly moved upwards by the thruster 17 of the thermal-sensitive element 13, in contrast with the action of the spring 38, so as to cause an angular movement of the gear 35, and a consequent rotation of the shutter 30 associated with it; it will be appreciated that also in this embodiment the thermal-sensitive element 13 operates in a direction substantially parallel to the axis of the sprinkler device 1.

Figure 5:
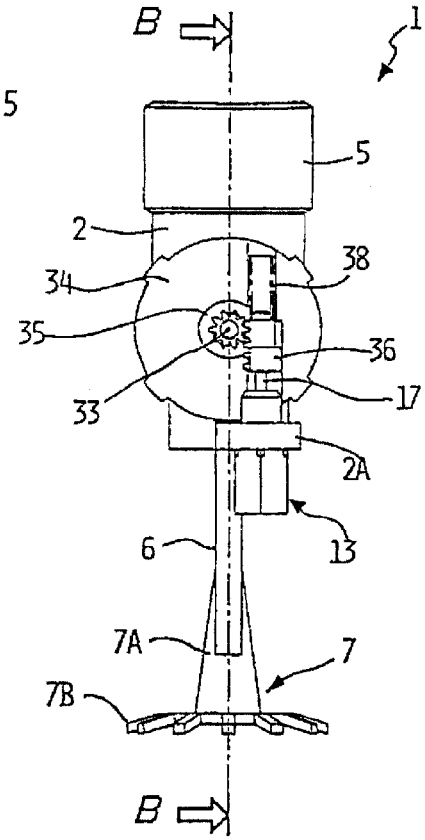
FIGS. 5 and 6 show a side view of a second possible embodiment of the sprinkler device according to the present invention, in two different working positions.

In FIGS. 5 and 7, the device 1 is represented in its rest position, where the main hole 31 of the shutter 30 is arranged angularly, i.e. orthogonally to the axis of the duct inside the body 2, so as to hinder the passage of the liquid to the outlet 4. Also in this embodiment, when the room temperature starts to increase, such as in case of a fire, the thermal-sensitive element 13 operates as previously described with reference to the embodiment of FIGS. 1–3. The consequent movement of the thruster 17 causes an upwards displacement of the rack kinematics 36, which caused an angular movement of the gear 15, and consequently a rotation of the shutter 30 to the position visible in FIG. 8; as it can be noticed, under this circumstances, the hole 31 of the shutter 30 results in being aligned with Me path inside the body 2, so that the liquid can freely outflow through the outlet 4, to be sprinkled as previously described.

Afterwards, when the room temperature decreases (for instance, because the fire in the environment with the device 1 has been extinguished), the thermal-sensitive element 13 cools down and the thruster 17 goes backward to its original position, under the thrust of the spring 38; then the shutter 30 can rotate towards the initial position represented in FIG. 7, for occluding the duct inside the body 2, and interrupting the liquid flow at the outlet 4. FIGS. 9–12 represent in several sections another possible embodiment of the sprinkler device according to the present invention; also these figures are partially using the reference numbers of the previous figures to indicate technical equivalent elements. In this instance, the device 1 provides a shutter of a third type, being similar to a slider, indicated as a whole with 40, i.e. operating along a direction being substantially transverse with respect to the axis of the liquid conveying duct.

The shutter 40 has a first lower supporting disk or plate 41 inserted in a suitable seat defined in the duct inside the body 2, upstream the outlet 4, and provided with a hole 42; a second plate or movable disk 43 rests on such a first plate 41, which has a hole 44, whose dimensions substantially match with the hole 42; a third upper disk or plate indicated with 45 is inserted in the duct inside the body 2, above the second plate 43, which has a hole 46 similar to the hole 42 of the plate 41.

Figure 9:
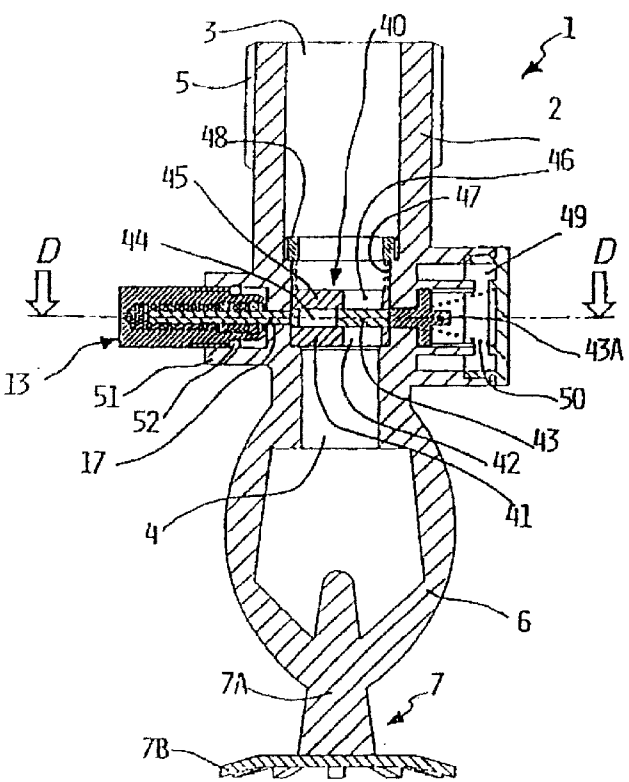

As it can be seen in FIG. 9, boles 42 and 46 of plates 41 and 45 are aligned to each other, whereas in the rest position of the device 1, the hole 44 of the movable plate 43 is out-of-axis with respect to said holes 42 and 46, so as to hinder the passage of fluid through the shutter 40.

Plates 41, 43 and 45, for example made from ceramic material, PTFE or Teflon® (or any other material suitable to that purpose, in particular with a hard surface and/or self-lubricating), have well finished surfaces and are placed one on top of the other to ensure a tight seal; such a seal is warranted by a mutual compression between said plates 41, 43 and 45 through a spiral spring 47, working between the upper plate 41 and a stop element 48, which has a central opening and is made integral with the duct inside the body 2, An extension 43A, going through an opening delimited in the body 2, departs from the movable plate 43, which ends in a side housing 49; an elastic element, such as a spiral spring 50, is present in the side housing 49, which reacts the extension 43A.

On the opposite side of the body 2 a seat 51 is provided, for a sealed fastening through a gasket 52 of the thermal-sensitive element 13; as it will be appreciated, the thruster 17 of the thermal-sensitive element 13 is inserted in an opening aligned with the resting plane of the movable plate 43, so as to have a thrust on the latter; therefore, in this instance, the thermal-sensitive device 13 operates in a substantially perpendicular direction with respect to the axis of the sprier device 1.

Figure 11:
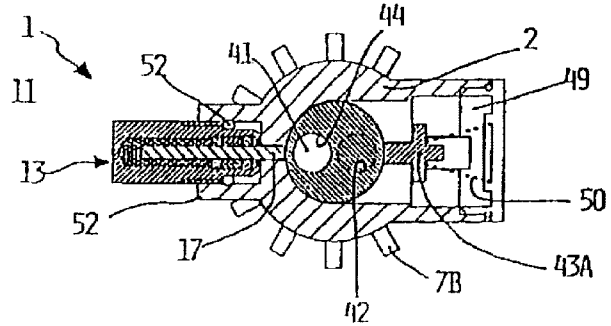

In the rest condition represented in FIGS. 9 and 11, the hole 44 of the movable plate 43 is out-of-alignment with respect to the holes 42 and 46 of the plates 41 and 45, so that the duct inside the body 2 is occluded and no liquid can flow towards the outlet 4.

When the thermal-sensitive device 13, on the contrary, is energized by a room temperature increase as previously described, the movement of the thruster 17 causes the movable plate 43 to move in contrast to the action of the spring 50.

Figure 10:
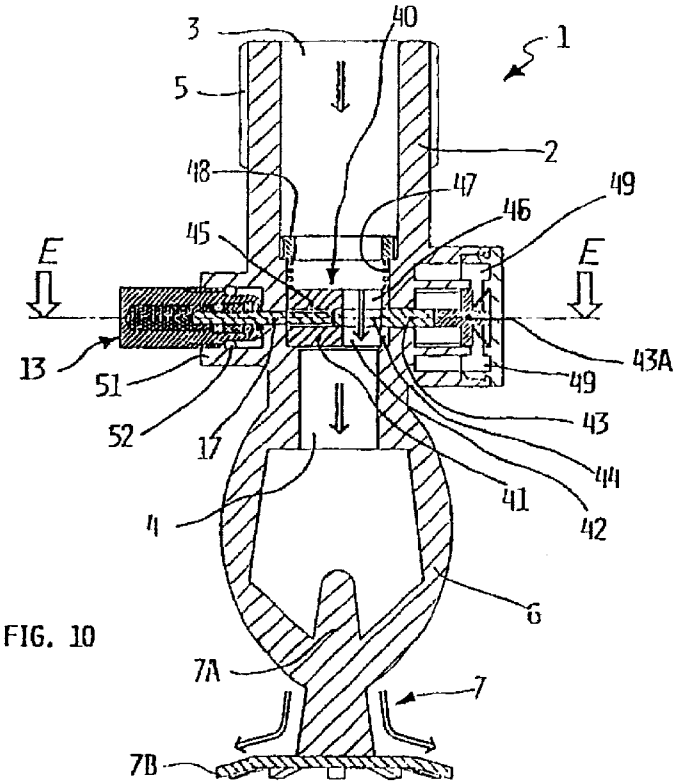
FIGS. 9 and 10 show a section view of a third possible embodiment of the sprinkler device according to the present invention in two different working positions.
Figure 12:
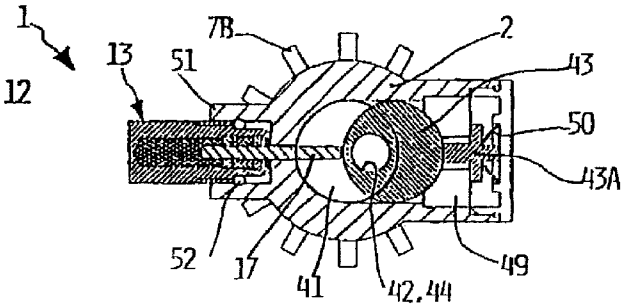
FIGS. 11 and 12 show a section view of the device according to the present invention, along the axis D—D of FIG. 9 and axis E—E of FIG. 10, respectively.

As it can be seen in FIG. 9, following such an actuation, holes 42, 44 and 46 are now aligned to each other, thus letting the liquid to pass to the outlet 4 for its rain sprinkling, It is clear, also in this instance, that as soon as room temperature decreases, the thermal-sensitive device 13 cools down, causing a consequent backward movement of the thruster 17 to its original position under the thrust of the spring 50 and the plate 43, which can go back to its closure position of the duct inside the body 2 as shown in FIGS. 8 and 10, so stopping the liquid flow at the outlet 4.

FIGS. 13–18 represent a further possible embodiment of the sprinkler device according to the present invention; also these figures partially use the reference numbers of the previous figures to indicate technical equivalent elements.

In this embodiment, the device 1 comprises a body 2 within which a side chamber 60 is defined; one end of said chamber 60 is closed by a plug 60A; as it will become apparent later, the chamber 60 is hydraulically connected to the inlet 3 and, through a passage 65, to the outlet 4.

Figure 16:
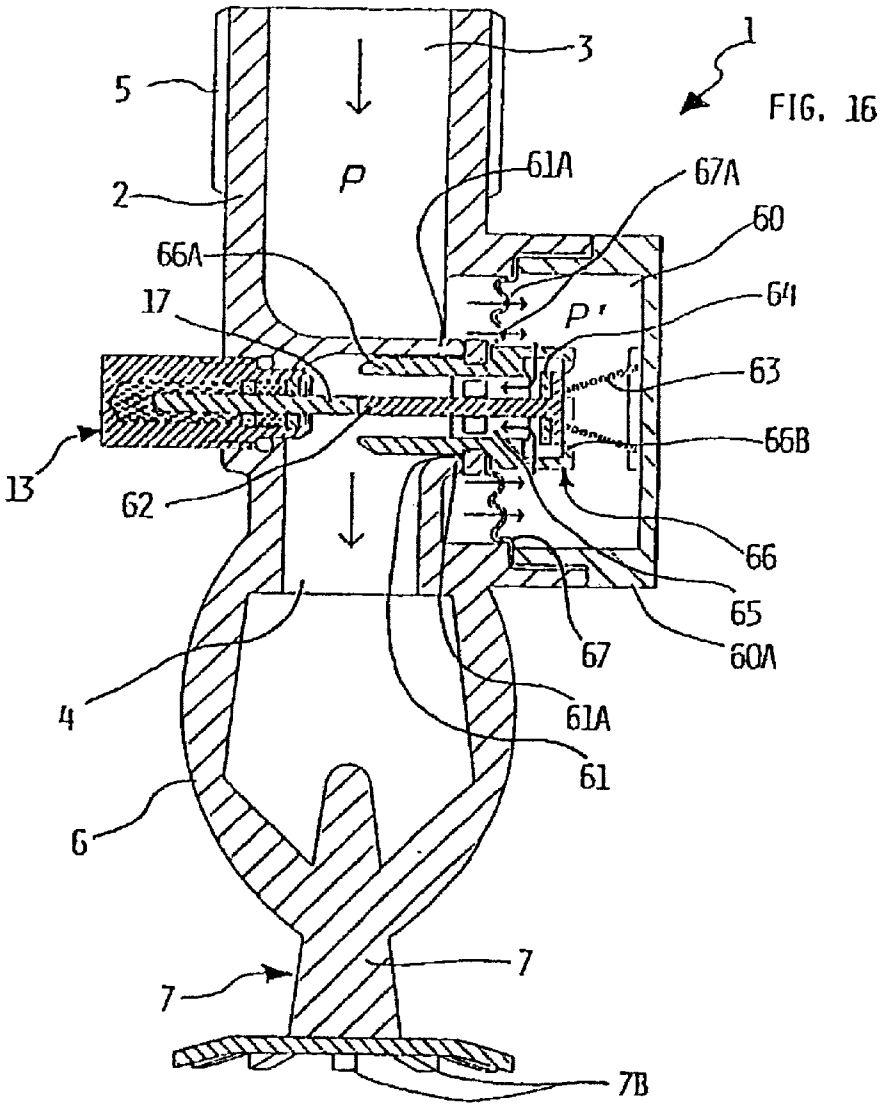
FIGS. 15, 16, 17 show a section view of the device according to the present invention, along the axis F—F of FIG. 14, in three different working conditions.
Figure 15:
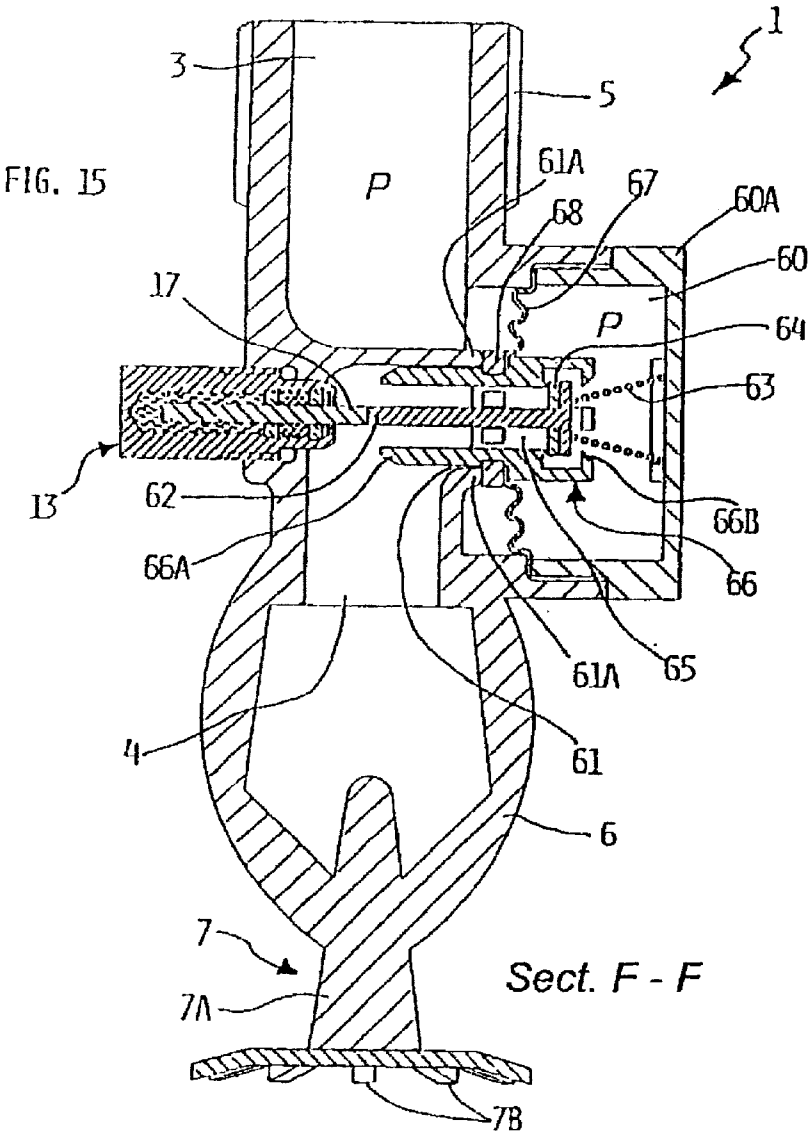
Figure 17:
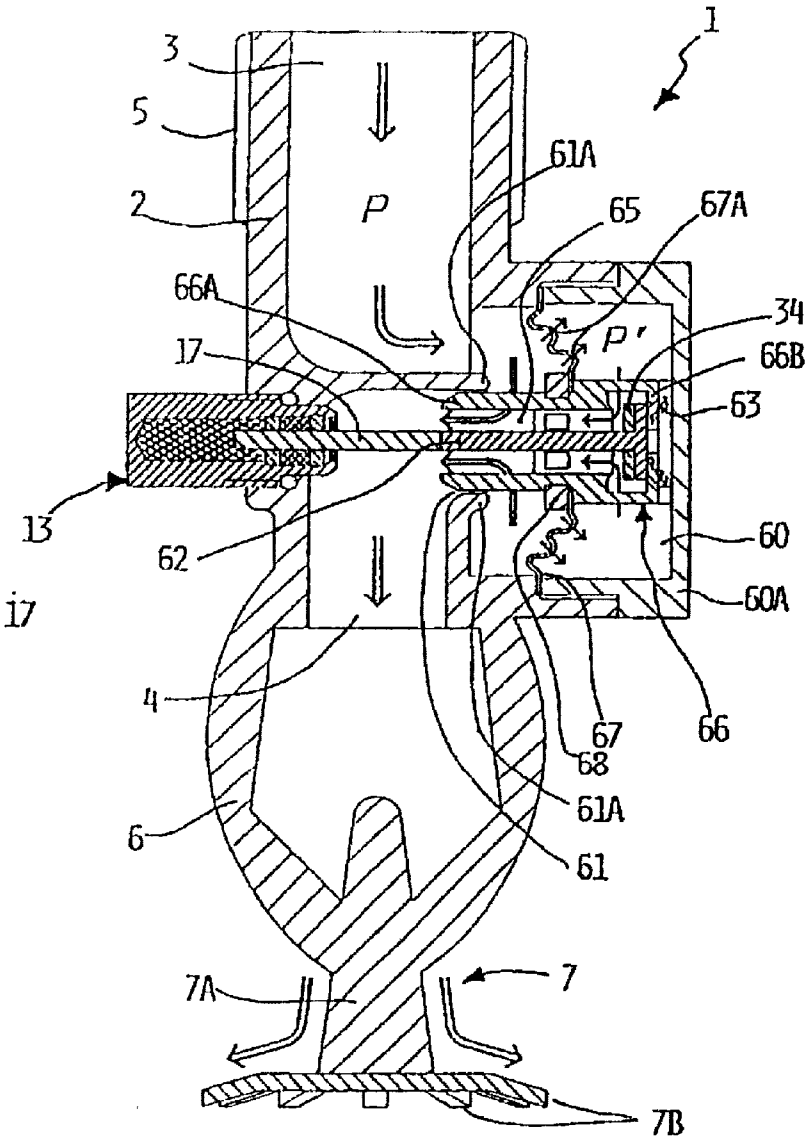

As it can be seen in FIGS. 15–17, the body 2 has a thermal-sensitive device 13 fastened to it, whose thruster 17 is apt to operate a thrust on one end of a movable slider 62, the other end of it being reacted by an elastic element 63 housed inside the chamber 60, such as a spiral spring; the slider 62 has a sealing gasket 64 apt to occlude the internal duct 65 of a shutter 66, which is movable within the passage 61.

The shutter 66 is integral with one end of a movable membrane 67 (for example manufactured from PTFB or Teflon® or flexible metal sheet), in particular through an elastic ring 68 also acting as a sealing element on the edges 61A of the passage 61; moreover, the shutter 66 is provided with first endings 66A, which are apt for sliding within the passage 61; the endings 66A are of the cross type, i.e. apt to let the liquid outflow also into said passage when the shutter 66 is in its open position (see for example FIG. 18); the shutter 66, too, has second endings 66B apt to receive the thrust of the end of the slider 62, when the latter is motioned by the thruster 17 of the thermal-sensitive device 13 (see for example FIG. 16).

The membrane 67 has holes 67A, which let the inlet 3 of the body 1 to communicate with the chamber 60; in particular, the total surface of such holes 67A is smaller than the free surface of the duct 65 inside the stopper 66.

Quite schematically, the operation of the sprinkler device 1 according to FIGS. 13–18 is as follows, bearing in mind that the device 1, as previously described, is of the normally closed type and, consequently, the position shown in FIG. 15 corresponds to its rest position, i.e. in the absence of a fire.

In this condition, the gasket 64 of the slider 62, being subject to the action of the spring 63, operates in closure of the duct 65 inside the shutter 66 and the shutter itself operates, through the gasket 68, in closure of the passage 61; the liquid not only fill the inlet 3, but also the chamber 60 through the holes 67A of the membrane 67.

Under these conditions, in the chamber 60 a pressure P is determined, which is equal to the pressure P being present at the inlet 3 (FIG. 15); such a pressure P inside the chamber is such to thrust on the membrane 67 to maintain the shutter 66 guided by its own endings 66A, in closure of the passage 61; as mentioned above, the shutter 66 seals the edges 61A through the gasket 68, so hindering the outflow of the fluid from the inlet 3 to the outlet 4. When the room temperature gradually starts to increase, for instance due to a fire, a gradual temperature raise of the thermal-sensitive element body 13 is determined; such a temperature increase causes an expansion of the expansible material 16 contained in the thermal-sensitive element 13, which moves the thruster 17 out of its relevant body 14; such a movement of the thruster 17 is translated into a movement of the slider 62 against the action of the spring 63 for the opening of the tankage 65 inside the stopper 66.

Under such an intermediate condition, as represented in FIG. 16, the gasket 64 of the slider 62 operates for the opening of the duct 65 inside the stopper 66, and the liquid in the chamber 60 outflows through the same duct 65 to the outlet 4; it should be appreciated that the liquid which is able to flow from the inlet 3 into the chamber 60, through the holes 67A of the membrane 67, has a restricted flow-rate with respect to the flow-rate admitted through the duct 65, due to said different sections.

Thus, in the chamber 60 a pressure reduction takes place to the value P' of the outlet 4, which is commonly at atmospheric pressure (FIG. 16).

In this situation, the pressure P at the inlet 3 is able to win the pressure P' in the chamber 60 and start moving, in the opposite direction to the previous one, the membrane 67 and then the shutter 66; it should be appreciated that when the end of the slider 62 comes to rest on the endings 66B, also the thrust of the actuator 13 contributes to motion the shutter 66.

Figure 18:
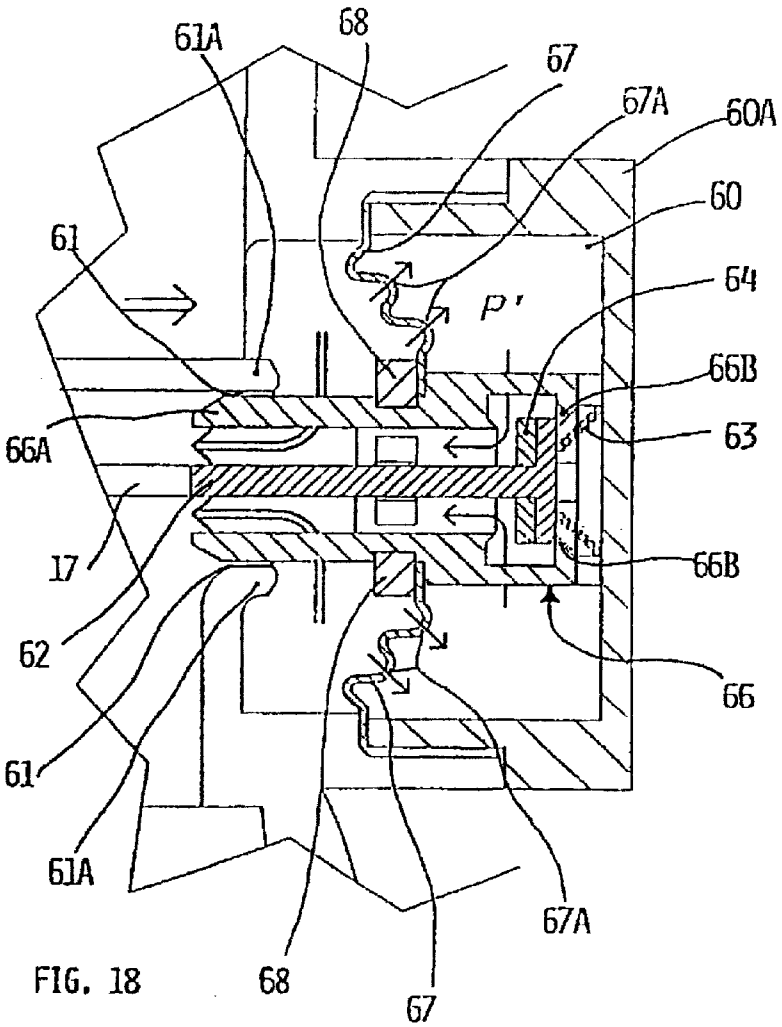
FIG. 18 shows an enlargement of a portion of FIG. 17.

As it can be seen in FIGS. 17 and 18, where the device 1 is represented fully open, the displacement of the shutter 66 releases at this point the passage 61, wherein to the liquid from the inlet 3 can now outflow sideways the endings 66A, which have a crosswise section, as said above.

The liquid can then reach the outlet 4 and from here flow to the distributor 7 where the flow is widened to fall rain wise on the environment to be protected.

It is obvious that afterwards, when the room temperature decreases (for example because the fire in the environment is extinguished ), the thermal-sensitive element 13 cools down and the material 16 contained therein shrinks; this causes the thruster 17 to go backward to its start position, due to the return of the slider 62 subject to a reaction of the spring 63.

Under these conditions, the gasket 64 of the slider 62 operates again for closing the duct 65 inside the shutter 66, and the pressure of the liquid in the chamber 60 increases up to its original value P, which is equal to the pressure in the inlet 3 and higher than the pressure at the outlet 4; such a pressure increase in the chamber 60 therefore causes the membrane 67 to have a movement opposite the previous one; the shutter 66, integral with the membrane 67, therefore moves and causes the gasket 68 to seal the edges 61A of the passage 61, which is now closed; thus the liquid flow at the outlet 4 is stopped.

Operation of the device 1 according to the embodiment of FIGS. 13–18 is typical of a servo-assisted valve type, i.e. using the same pressure of the mains liquid for easing both the opening and closing operations, paired to a direct actuation trough a thermostatic element 13.

In the instance of the application according to the present invention, such a servo-assisted solution is apt to warrant a safe operation of the device 1 also in the presence of high fluid pressures, since the actuator 13 is not required to fully contrast the force exerted by the pressure P on the shutter 66, but rather only the one exerted on the surface of the slider 62, which has a smaller amplitude; moreover, the trust produced by the actuator 13 on endings 66B of the shutter 66 allows for obviating to possible faults, such as a jamming of the shutter itself, due to scaling or many years of inactivity; under such irregular conditions, a bimetal would not be enough to cause the opening for the liquid to flow through.

It should be noticed that thermal-sensitive elements 13 having also an actuator function of the type as provided by the present invention, are of simple and cheap manufacturing and apt to develop a considerable power in relationship to their small dimensions.

As a result, the overall dimensions of the thermal-sensitive/actuator element can be reduced, though obtaining an equal or higher power that can be developed by it with respect to the commonly known solutions, with an excellent reliability and fast and accurate operation; this also entails the possibility of obtaining sprinkler devices 1 with smaller overall dimensions than those provided by the known state of the art.

It should also be appreciated that according to the examples of the present invention described above, the motion of the thruster 17 is directly caused by the expansion of the expansible material 16, i e. such a motion is not "averaged" by any isolating means between the two elements, such as a rubber membrane; the element 13 differs from the thermal actuators commonly known and used in thermostatic valves for sanitary use, which require an insulating membrane between the expansion chamber of the expansible material and the thruster; such a membrane used in the known applications is commonly obtained from elastic materials, which are not suitable for operation at temperatures over 100° C. On the contrary, the thermal-sensitive element 13 can also operate at temperatures over 200° C., through the use of the bushing 21 made from PTFE or Teflon®.

According to the above, it will be apparent how the object of the present invention represents an improvement with respect to the present state of the art.

With regard to commonly known solutions using breakable bulbs or melting alloys, the sprinkler device 1 according to the present invention has the advantage of having room temperature sensing means, which do not necessarily need to be replaced after their first operation.

Another advantage of the sprinkler device 1 according to the present invention is that it can also be manufactured as a self-resettable device.

Compared to the known solutions using bimetal elements, the sprinkler device 1 according to the present invention develops a considerable power, apt to reduce a jamming risk for the shutter due to scaling or many years of inactivity, in spite of the very small size of its thermal-sensitive element 13.

An associated advantage is represented by the fact that the use of the thermal-sensitive device 13 allows for providing for the device 1 a large number of technical solutions for shutting purposes, in spite of its reduced dimensions and low cost; as previously described, in fact, it is possible to provide shutters with axial, angular or perpendicular motion with respect to the direction of the flow to be stopped or shutting systems which use the same pressure of the liquid for facilitating both the opening and closing operations of the device. According to the above description, the features of the sprinkler device for fire extinguishing systems provided by the present invention are clear, as well as also its advantages are clear.

It is obvious that many changes are possible for the man skilled in the art to the sprinkler device for fire extinguishing systems described by way of example, without departing from the invention, and it is also clear that in practical actuation of the present invention the components described may have a different shape and material and be replaced by technical equivalent elements.

For instance, the thermal-sensitive element 13 may be manufactured using several sealing elements for the closure of the housing 14. Similarly the bushing 21, due to the fact that it is subject to distortions for matching with the surrounding surfaces and/or free spaces, may have a different configuration from the one shown by way of example.

With reference to the embodiment of FIGS. 1–3, several thermal-sensitive elements 13 can be provided in parallel, in order to increase the available power for winning the contrary thrust of the pressurized fluid, which is the higher the more the shutter surface is wider.

With reference to the embodiment of FIGS. 13–18, the passage 61 and all components associated to it, such as the actuator 13, the slider 62, the membrane 67, etc., may be angularly oriented with respect to the inlet 3 (for example 45° instead of 90°), so as to reduce the tortuosity of the fluid path.

Figure 19:
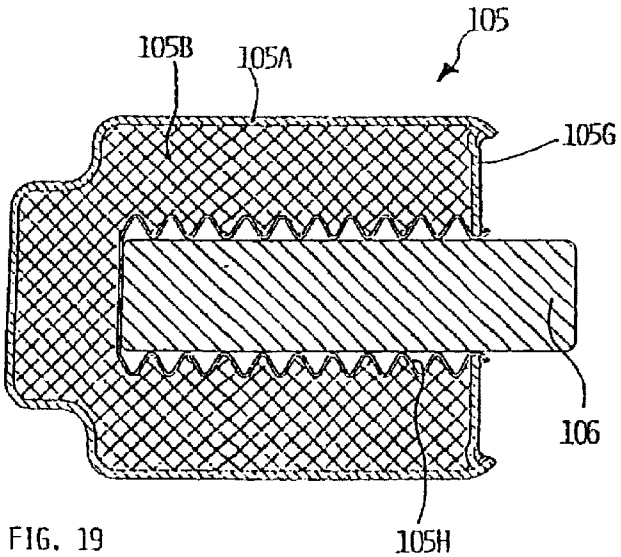
FIG. 19 shows a possible embodiment of the thermal-sensitive element being part of the sprinkler device according to the present invention.

A further possible change relates to the manufacture of the thermal-sensitive element, which could be similar to the one represented in FIG. 19.

Such a thermosetting element indicated with 105 has a body 105A, delimiting a chamber containing an expansible material indicated with 105B, which in this case is a fluid such as a special alcohol or solvent;

The body 105A has a lengthwise opening, which is closed by a washer 105G made from rigid material; a metal sealing bellows 105H closed on one end is fixed in correspondence of the central hole of the washer 105G, which extends towards the chamber inside containing the fluid 105B; finally, the thruster of the thermal-sensitive element is indicated with 106, which is partially inserted in the bellows 105H through the central hole of the washer 105G.

As to the assembly of the element 105, the bellows 105H is fastened to the central hole of the washer 105G, such a coupling between the components being ensured by welding, brazing, tinning or a similar procedure. It should also be noticed that the washer 105G, has a shaping near its edge on one of its faces, and the bellows 105H extends from the opposite face of said washer.

The washer 105G is then placed in correspondence with the lengthwise opening of the body 105A and the latter is mechanically riveted, i.e. folded on the washer itself; also in this instance, in order to warrant a safe sealed closure, the washer 105G is sealed to the body 105A in correspondence of its own shaping, for example by welding, brazing, tinning, etc.

Then the bellows 105H is properly pre-tensioned towards the inside of the body 105A, and the latter is filled with fluid 105B; the fluid is introduced in the body 105A through a suitable opening, not shown in the figure, which at the end of the operation is closed by a small ball. Finally, a portion of the thruster 106 is inserted in the bellows 105H, through the central hole of the washer 105G.

Operation of the thermal-sensitive element 105 is similar as previously described with reference to the thermal-sensitive element 13. In particular, a temperature increase in the environment determines a temperature raising of the body 105A and such a temperature increase cause expansion of the expansible fluid 105B; the expansion of the fluid is discharged on the bellows 105H, which is gradually compressed towards the washer 105G, causing a motion of the thruster 106 for exiting the body 105A.

Afterwards, when the room temperature decreases, the body 105A cools down and the fluid contained in it shrinks; this allows a backward movement of the thruster 106 and bellows 105H to their starting positions, respectively, also due to the action of the elastic elements provided by the sprinkler device where the thermal-sensitive element is used, and to the vacuum existing in the body 105A.

It should be noticed that the thermal-sensitive element 105 represented in FIG. 19 does not require any rubber gasket or in other temperature degradable material; by this particular embodiment, moreover, a temperature sensing element could be provided, being remote with respect to the thermal-sensitive element 105, and connected to it through a capillary flexible metal tube.

Other possible embodiments provide thermal insulating means between the housing 14 or 105A of the thermal-sensitive element 13 or 105 and the body 2 of the sprinkler device 1, in order to avoid heat dissipation from said housing to said body; such means may consist of a bushing in suitable insulating material, made integral with the body 2, wherein the housing 14 or 105A would be fastened.

Finally, it is clear that due to the high power of the thermal-sensitive element 13, many other types of shutter can be advantageously used on the sprinkler device according to the present invention, with restricted overall dimensions.

What is claimed is:

1. Sprinkler device for fire extinguishing systems, to be coupled with a fluid supply line and positioned in an environment which has to be protected from fire, comprising:

a body (2) having an inlet (3), for connection with said supply line, and an outlet (4), for the fluid outflow, a passageway for the fluid being defined between said inlet (3) and said outlet (4), servo-assisted shutter means (60–68) for hindering, when in a respective rest position of the sprinkler device (1), the fluid outflow from said outlet (4), said shutter means including at least a membrane (67) and a movable shutter (66);

actuation means (13;105) sensitive to the room temperature which, upon a predetermined room temperature threshold being exceeded, causes said shutter means (60–68) to move towards a respective work position for allowing fluid outflow from said outlet (4), said actuation means (13;105) comprising an unbreakable container (14;105A) defining an internal cavity (15) containing a material (16;105B) whose volume increases or decreases as a function of the temperature of said container (14;105A), said temperature being determined directly by the room temperature;

a shaft (17;106) movable as a function of the increase or decrease of the volume of said material (16;105B) between a rest position and a work position, for moving said shutter means (60–68) from their rest position to their work position; and means (20–22;105G–105H) for closing and sealing said cavity (15) with respect to said shaft (17;106), wherein the motion of said shutter means (60–68) from their rest position to their work position is caused by the fluid pressure on said membrane (67), fastened between said movable shutter (66) and said body (2), in combination with a direct actuation produced by said shaft (17;106).

2. Sprinkler device, according to claim 1, wherein said shutter means (60–68) comprise a chamber (60) in hydraulic communication with said passageway.

3. Sprinkler device, according to claim 2, wherein said shutter means (60–68) comprise a movable slider (62) acted upon by an elastic element (63) and moved by said shaft 17;106) towards a respective work position.

4. Sprinkler device, according to claim 3, wherein said movable shutter (66) operates within said passageway and has an internal duct (65) which can be closed by said movable slider (62).

5. Sprinkler device, according to claim 4, wherein said membrane (67) has openings (67A) for putting said passageway into communication with said chamber (60).

6. Sprinkler device, according to claim 5, wherein the total surface of said openings (67A) is smaller than the free surface of said internal duct (65) of the shutter (66).

7. Sprinkler device, according to claim 5, wherein said movable membrane (67) is made from flexible metal sheet.

8. Sprinkler device, according to claim 5, wherein said movable membrane (67) is made from PTFE or Teflon®.

9. Sprinkler device, according to claim 5, wherein, the rest position of the device (1), said slider (62) closes said internal duct (65) of the shutter (66) and said shutter (66) closes said passageway, whereby fluid is present within said chamber (60) having a first pressure (P) substantially equal to the pressure of the fluid present in said passageway upstream of said shutter (66), said first pressure (P) causing a thrust on said membrane (67) for maintaining said passageway closed by said shutter (66).

10. Sprinkler device, according to claim 9, wherein the movement of said shaft (17;106) causes a movement of said slider (62) for opening said internal duct (65) of the shutter (66) in order to allow fluid contained in said chamber (60) to outflow from said outlet (4) and cause a second fluid pressure (P') within said chamber (60), said second fluid pressure being lower than said first pressure, so that the pressure (P) of the fluid in said passageway upstream of said shutter (66) is able to move said membrane (67) then said shutter (66) for opening said passageway.

11. Sprinkler device, according to claim 5, wherein the return of said shaft (17;106) to the respective rest position allows the return of said slider (62), closing said internal duct (65) of the shutter (66), with a consequent return of the fluid in said chamber (60) to said first pressure (P) and the movement of said membrane (67) which cause said shutter (66) to close said passageway.

12. Sprinkler device, according to claim 1, wherein, when the room temperature goes below said temperature threshold, the movement of said shaft (17;106) from its work position to its rest position causes said shutter means (60–68) to go back to their rest position.

13. Sprinkler device, according to claim 1, wherein said shaft (17) has at least a first end portion constantly inserted in said cavity (15) and a second end portion constantly outside said cavity (15), said first end portion being constantly inserted in said material (16) or directly in contact with said material (16).

14. Sprinkler device, according to claim 1, wherein said material (16;105B) is a wax.

15. Sprinkler device, according to claim 1, wherein said material (16;105B) is a fluid that is thermally expansible.

16. Sprinkler device, according to claim 1, wherein said body (2) comprises a threaded seat, into which said container (14;105A) is threaded.

17. Sprinkler device, according to claim 1, wherein said closure and sealing means (20–22) comprise radial sealing means (21), which operate directly between said shaft and a surface of said cavity (18).

18. Sprinkler device, according to claim 17, wherein said closure and sealing means (20–22) comprise lower supporting means (20) for said sealing means (22), said lower supporting means (20) being disposed at a predetermined position on said body (2), said closure element (22) and said lower supporting means (20) delimiting a housing area (18) with said body (2) for said radial sealing means (21).

19. Sprinkler device, according to claim 18, wherein said lower supporting means comprises a rigid washer 20).

20. Sprinkler device, according to claim 17, wherein said closure means (22) is positioned in a first seat (19) defined in said body (2) and said radial sealing means (21) are positioned in a second seat (18) defined in said body (2), which is smaller than said first seat (19).

21. Sprinkler device, according to claim 20, wherein said lower supporting means (20) are housed in said second seat (18).

22. Sprinkler device, according to claim 17, wherein said radial sealing means comprises a cylindrical bushing (21).

23. Sprinkler device, according to claim 1, wherein said closure and sealing means (20–22) comprise at least a closure element (22), which mechanically cooperates with said body (2) and has a central opening for guiding said shaft (17).

24. Sprinkler device, according to claim 1, wherein said closure means comprises a rigid washer (22).

25. Sprinkler device, according to claim 1, wherein said unbreakable container (105A) has a lengthwise opening and said closure and sealing means comprise a sealed bellows (105H) closed on one end.

26. Sprinkler device, according to claim 25, wherein said sealed bellows (105H) extends towards the inside of said cavity containing said material (105B).

27. Sprinkler device, according to claim 1, further comprising thermal insulating means between said body (2) and said container (14; 105A).

28. Sprinkler device for fire extinguishing systems, to be coupled with a fluid supply line and positioned in an environment which has to be protected from fire, comprising:

a body having an inlet (3), connected to said supply line, and an outlet (4), for fluid outflow, a passageway for the fluid being defined between said inlet (3) and said outlet (4), shutter means (8–12) for hindering, when in a respective rest position of the sprinkler device (1), the fluid outflow from said outlet (4);

actuation means (13;105) sensitive to the room temperature which, upon a predetermined room temperature threshold being exceeded, causes said shutter means (8–12) to move towards a work position for allowing fluid outflow from said outlet (4), said actuation means (13;105) comprising:

an unbreakable container (14;105A) defining an internal cavity (15) containing a material (16;105B) whose volume increases or decreases as a function of the temperature of said container (14;105A), said temperature being determined directly by the room temperature;

a shaft (17;106) movable as a function of the increase or decrease of the volume of said material (16;105B) between a rest position and a work position, for moving said shutter means (8–12) between their respective rest and work positions, respectively, said shaft (17;106) having at least a first end portion constantly inserted in said cavity (15) and a second end portion constantly outside said cavity (15); and means (20–22;105G–105H) for closing and sealing said cavity (15) with respect to said shaft (17;106), and wherein said shutter means (8–12) comprise, a shutter (8) movable along a direction substantially parallel to, or coinciding with, the axis of said passageway;

a lever (11) pivotally mounted on said body (2), an end of said lever (11) movable by said second portion of said shaft (17;106), the opposite end of said lever (11) causing movement of said shutter (8) for opening said passageway.

29. Sprinkler device, according to claim 28, further comprising elastic means (10) for returning said shutter (8) to a relevant rest position when the room temperature goes below said predetermined temperature threshold.

30. Sprinkler device for fire extinguishing systems, to be coupled with a fluid supply line and positioned in an environment which has to be protected from fire, comprising:

a body having an inlet (3), connected to said supply line, and an outlet (4), for the fluid outflow, a passageway for the fluid being defined between said inlet (3) and said outlet (4), shutter means (30–36,38) for hindering, when in a respective rest position of the sprinkler device (1), the fluid outflow from said outlet (4);

actuation means (13;105) sensitive to the room temperature which, upon a predetermined room temperature threshold being exceeded, causes said shutter means (30-36-38) to move towards a work position for allowing the fluid outflow from said outlet (4), said actuation means (13;105) comprising:

an unbreakable container (14;105A) defining an internal cavity (15) containing a material (16;105B) whose volume increases or decreases as a function of the temperature of said container (14;105A), said temperature being determined directly by the room temperature;

a shaft (17;106) being movable in function of the increase or decrease of the volume of said material (16;105B) between a rest position and a work position, for moving said shutter means (8–12) between their rest position and work position, respectively, said shaft (17;106) having at least a first end portion constantly inserted in said cavity (15) and a second end portion constantly outside said cavity (15);

means (20–22;105G–105H) for closing and sealing said cavity (15) with respect to said shaft (17;106), said shutter means (30-36-38) comprising a shutter (30) rotatable around an axis transverse with respect to an axis of said passageway, said shutter (30) having an opening (31) which, in a work position is in alignment with said passageway and, in a rest position, is out of alignment with said passageway; and means (35,36) for converting a linear motion of said shaft (17;106) into an angular motion of said shutter (30), for moving said shutter (30) from said rest position to said work position.

31. Sprinkler device, according to claim 30, wherein said means for converting comprises a gear (35) integral with said shutter (30), and a rack element (36) coupled to said gear (35) and capable of being linearly moved by said shaft (17;106).

32. Sprinkler device, according to claim 30, further comprising elastic means (38) for returning said rotatable shutter (8) to said rest position when the room temperature goes below said predetermined temperature threshold.

* * * * *